US007698901B2

(12) United States Patent
Koons et al.

(10) Patent No.: US 7,698,901 B2
(45) Date of Patent: Apr. 20, 2010

(54) ICEMAKER ASSEMBLY FOR A REFRIGERATOR

(75) Inventors: Bill Koons, Cedar Rapids, IA (US); Mark Jeffery Reimer, Coralville, IA (US)

(73) Assignee: Maytag Corporation, Benton Harbor, MI (US)

( * ) Notice: Subject to any disclaimer, the term of this patent is extended or adjusted under 35 U.S.C. 154(b) by 790 days.

(21) Appl. No.: 11/485,475

(22) Filed: Jul. 13, 2006

(65) Prior Publication Data

US 2008/0011010 A1 Jan. 17, 2008

(51) Int. Cl.
*F25C 1/00* (2006.01)
*F25B 39/02* (2006.01)
*F25B 41/06* (2006.01)

(52) U.S. Cl. ..... 62/137; 62/504; 62/525; 62/527

(58) Field of Classification Search ..... 62/137, 62/504, 525, 527, 344
See application file for complete search history.

(56) References Cited

U.S. PATENT DOCUMENTS 3,874,559 A 4/1975 Pink
4,084,725 A 4/1978 Buchser
4,252,002 A * 2/1981 Mullins, Jr. ..... 62/344
5,037,004 A 8/1991 Katz et al.
5,117,654 A 6/1992 Steffenhagen
5,273,219 A 12/1993 Beach, Jr. et al.
6,010,037 A 1/2000 Thompson
6,082,130 A 7/2000 Pastryk et al.
6,425,259 B2 * 7/2002 Nelson et al. ..... 62/344
6,952,936 B2 * 10/2005 Sannasi et al. ..... 62/344
2002/0189269 A1 * 12/2002 Midden et al. ..... 62/136

* cited by examiner

*Primary Examiner*—Thomas E Denion
*Assistant Examiner*—Michael Carton
(74) *Attorney, Agent, or Firm*—Kirk W. Goodwin; Diederiks & Whitelaw PLC

(57) ABSTRACT

A refrigerator icemaker assembly includes a bin having a bottom wall, as well as first and second pairs of opposing side walls. One of the first pair of opposing side walls includes an opening within which is movably mounted a coupler. The coupler is provided with a recessed portion having formed therein an aperture and a cog member. An auger is rotatably mounted in the bin and includes a first end portion that extends through the aperture of the coupler. A drive member extends into the coupler and drives the auger in a first direction to dispense ice cubes and in a second direction to dispense crushed ice. The driver engages with the cog member when being rotated in the first direction and directly engages the first end of the auger when being driven in the second direction.

16 Claims, 5 Drawing Sheets

ICEMAKER ASSEMBLY FOR A REFRIGERATOR

BACKGROUND OF THE INVENTION

1. Field of the Invention

The present invention pertains to the art of refrigerators and, more particularly, to a drive and coupler arrangement for operating an icemaker auger for a refrigerator.

2. Discussion of the Prior Art

Providing an icemaker in a freezer compartment of a refrigerator is widely known in the art. In general, the icemaker forms ice cubes which are stored in a bin or hopper for later retrieval by a consumer. The ice cubes can be manually removed from the bin or, alternatively, dispensed through a door dispenser. Often times, in refrigerators that incorporate door dispensers, the icemaker will include a mechanism for selectively crushing the ice cubes. In any event, the bin is occasionally removed from the freezer compartment, either to remove a large number of ice cubes, or simply for cleaning purposes.

When the icemaker is employed in combination with a door dispenser, an auger is provided in the bin. The auger is typically operated by a drive member mounted in the freezer compartment and selectively rotated to deliver ice cubes to the dispenser, often with the auger rotating in a first direction to deliver ice cubes to the dispenser and in a second direction to deliver crushed ice. In order to allow the bin to be removed from the freezer compartment, the auger must be connected to the drive member through a detachable coupler. When reinserting the bin into the freezer compartment, the coupler and the drive member can be misaligned, resulting in difficulties in replacing the bin and/or improper auger operation.

Based on the above, despite the presence of icemakers in the prior art, there still exists a need for an icemaker employing a coupler that ensures proper alignment when replacing an ice bin in a freezer compartment. More specifically, there exists a need for a coupler that easily interconnects with a drive member, yet still ensures a positive connection when driving an auger to dispense either cubed or crushed ice.

SUMMARY OF THE INVENTION

The present invention is directed to a refrigerator having a cabinet defining at least a freezer compartment within which is mounted an icemaker assembly. In accordance with the invention, the icemaker assembly includes a bin, removably mounted in the freezer compartment, having a bottom wall and first and second pairs of opposing side walls. Preferably, one of the first pair of opposing side walls includes an opening within which is movably mounted a coupler. The coupler is provided with a recessed portion having formed therein an aperture and a cog member.

In further accordance with the invention, the icemaker assembly includes an auger rotatably mounted in the bin. The auger includes a first end portion that extends through the aperture of the coupler and leads to a second end portion that is supported on another one of the first pair of opposing side walls of the bin. Actually, the second end of the auger is operatively connected to an ice dispenser/crusher. The auger is operated by a drive member extending within the freezer compartment and operatively connected to the coupler. The drive member is driven in a first direction, engaging both the second end of the auger and the cog member resulting in a corresponding rotation of the auger to dispense ice cubes from the bin, and a second direction, again, engaging both the second end of the auger and the cog member resulting a corresponding rotation of the auger, to dispense crushed ice cubes from the bin.

The drive member includes first and second arm members, each provided with an arcuate notch arranged on one edge portion and a drive flat arranged on an opposing edge portion. In an ice cube dispensing operation, the drive flat of the first arm member engages with the second end of the auger, and the drive flat of the second arm member engages with the cog member. In a crushed ice dispensing operation, the second arm member engages with the second end of the auger with the second end of the auger being received by the arcuate notch, and the drive flat of the first arm member engages with the cog member. In this manner, the coupler/drive member arrangement ensures a positive connection to the auger when operating the icemaker assembly, particularly during a crushed ice dispensing operation when forces on the icemaker assembly could cause the bin to migrate away from the drive member.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
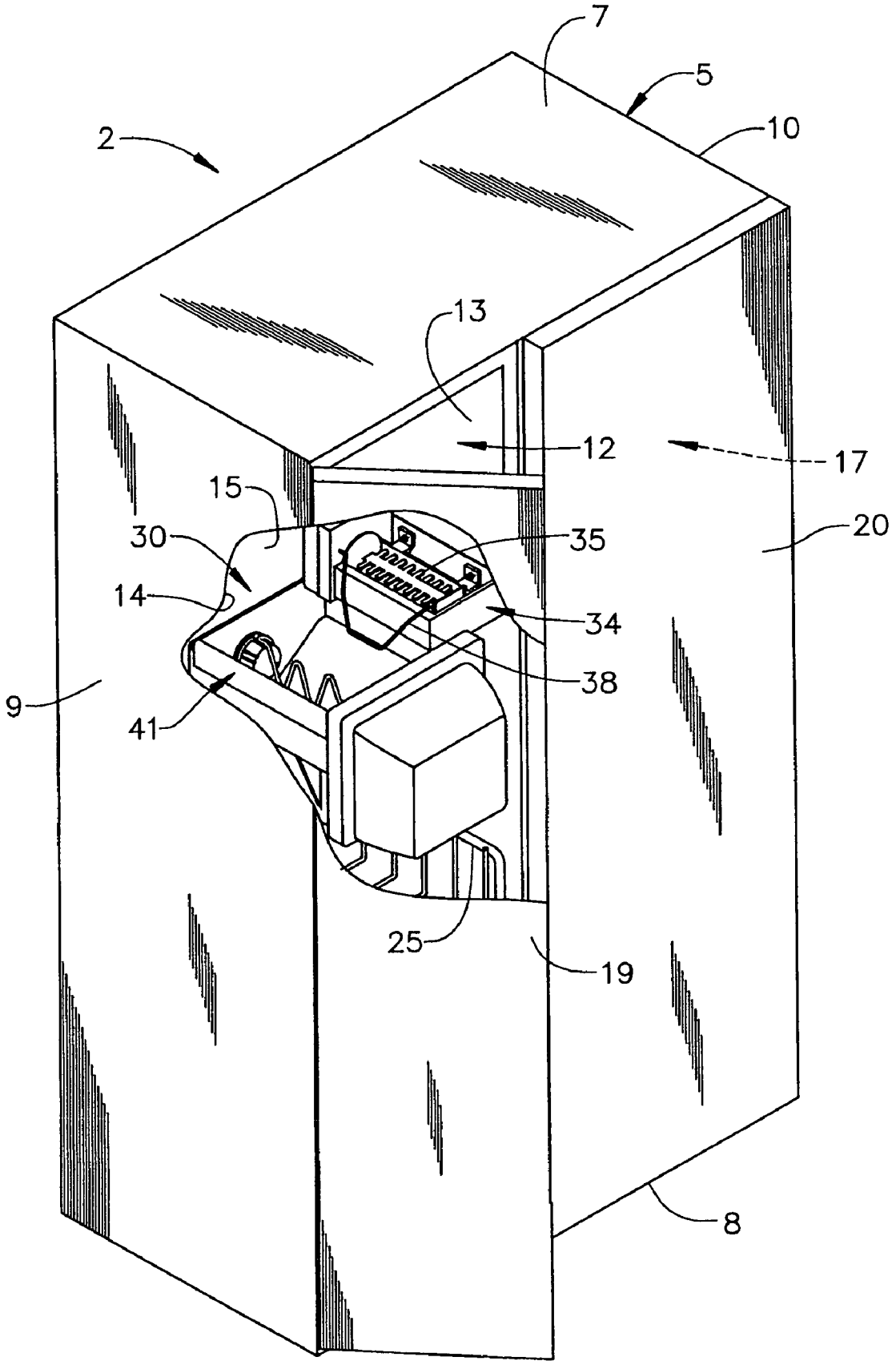
FIG. 1 is an upper left, partial sectional view of a side-by-side refrigerator incorporating an icemaker assembly constructed in accordance with the present invention.

With initial reference to FIG. 1, a refrigerator generally indicated at 2 is shown to include a cabinet 5 having top, bottom and opposing side walls 7-10. Cabinet 5 includes a freezer compartment 12 having opposing side and rear walls 13-15, and a fresh food compartment 17. In a manner known in the art, refrigerator 2 includes a freezer compartment door 19 that is pivotally mounted relative to cabinet 5 for selectively closing freezer compartment 12, as well as a fresh food compartment door 20 which is likewise pivotally mounted to cabinet 5 for selectively closing fresh food compartment 17. In a manner also known in the art, freezer compartment 12 includes a basket 25 for selectively storing food items. Of course, it should be understood that additional baskets, shelves, or the like could also be provided in freezer compartment 12.

Freezer compartment 12 is also shown to include an icemaker assembly 30 having an icemaker unit 34 provided with an ice mold portion 35 and a bail arm 38. Bail arm 38 is selectively shiftable into and out of an ice storage unit or bin 41 depending upon a level of ice cubes stored therein. That is, as the level of ice cubes within ice storage bin rises, bail arm 38 also rises, ultimately resulting in de-activating icemaker unit 34 in a manner known in the art. Conversely, as a level of ice cubes in bin 41 drops, bail arm 38 drops to re-activate icemaker unit 34, thereby establishing a new ice production cycle. In general, the above described structure has been provided for the sake of completeness and to enable a better understanding of the drawings. Instead, the present invention is directed to particulars of icemaker assembly 30 as discussed below.

Figure 2:
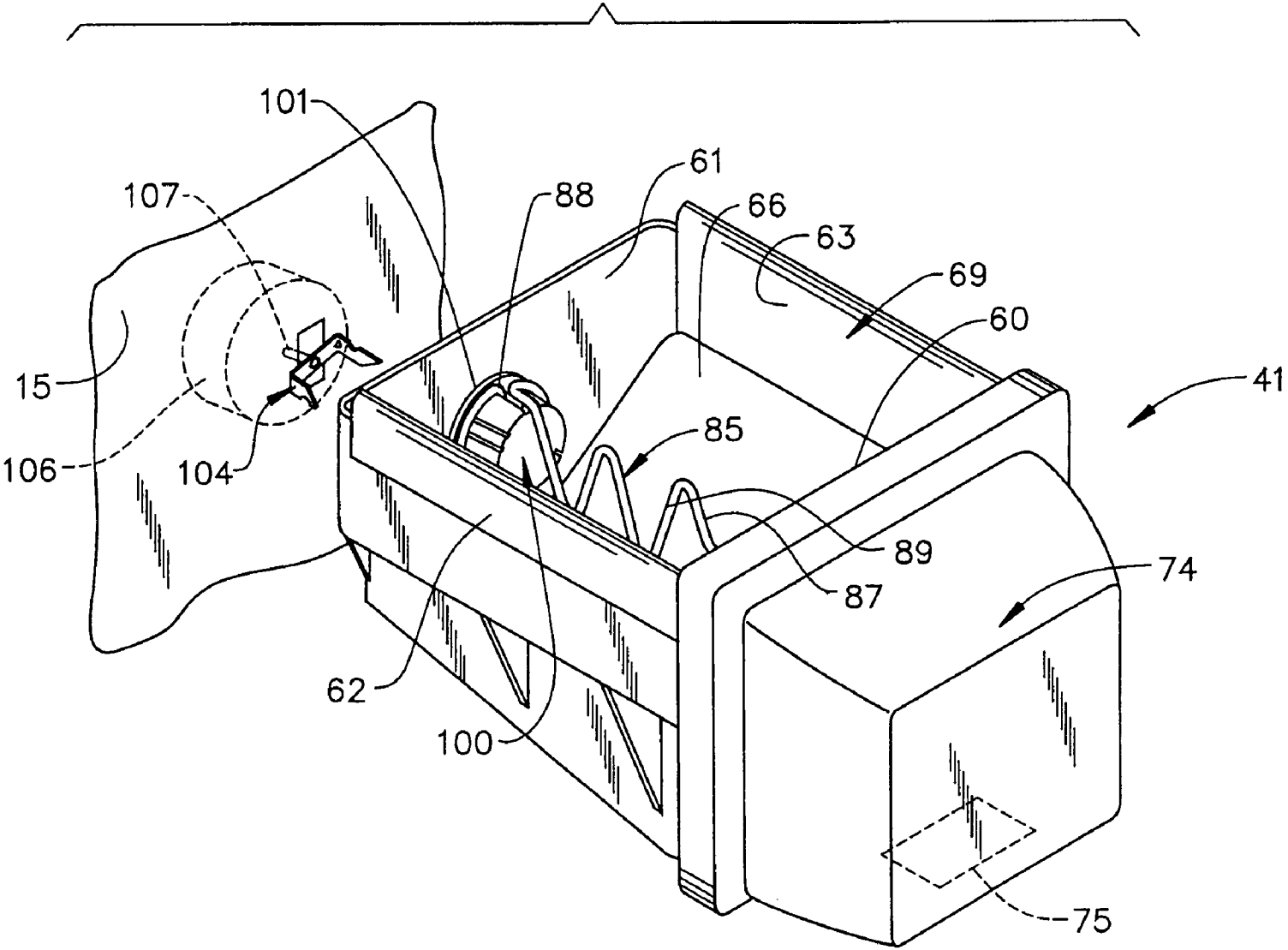
FIG. 2 is an upper left perspective view of a bin of the icemaker assembly, illustrating an auger, coupler and drive member.

As best shown in FIG. 2, bin 41 includes a first pair of opposing side walls 60 and 61, a second pair of opposing side walls 62 and 63, and a bottom wall 66 that collectively form an ice storage area 69. Preferably, bottom wall 66 is angled so as to direct ice cubes towards a central, lower forward portion (not separately labeled) of ice storage area 69. Bin 41 also includes a crusher/dispenser unit 74 having a lower outlet 75. As will be discussed more fully below, crusher/dispenser unit 74 directs ice cubes or crushed ice, as selected by a consumer, through lower outlet 75 towards a door dispenser (not shown).

Bin 41 also includes an auger 85 positioned above bottom wall 66. As discussed more fully below, auger 85 can be selectively rotated in either clockwise or counterclockwise directions to guide ice cubes from ice storage area 69 to crusher/dispenser unit 74. Towards that end, auger 85 includes a first end portion 87 that is rotatably supported by side wall 60, leading to a second end portion 88 through an intermediate helical or serpentine portion 89. Actually, first end portion 87 is operatively coupled to a blade (not shown) of crusher/dispenser unit 74. In accordance with the invention, second end 88 is supported for rotation on side wall 61 through a coupler 100. More specifically, coupler 100 is positioned within an opening 101 formed in side wall 61 and attached to second end portion 88 of auger 85. Actually, second end portion 88 of auger 85 wraps around and extends into coupler 100 in a manner that will be discussed more fully below. In any case, coupler 100 is adapted to receive a drive member 104 provided adjacent rear wall 15 of freezer compartment 12. Drive member 104 is operatively connected to a motor 106 through a shaft 107 that projects through an opening (not separately labeled) of rear wall 15. Motor 106 selectively rotates auger 85, through coupler 100, in either a clockwise or counterclockwise direction depending upon a particular consumer selection as will be described more fully below.

Figure 3:
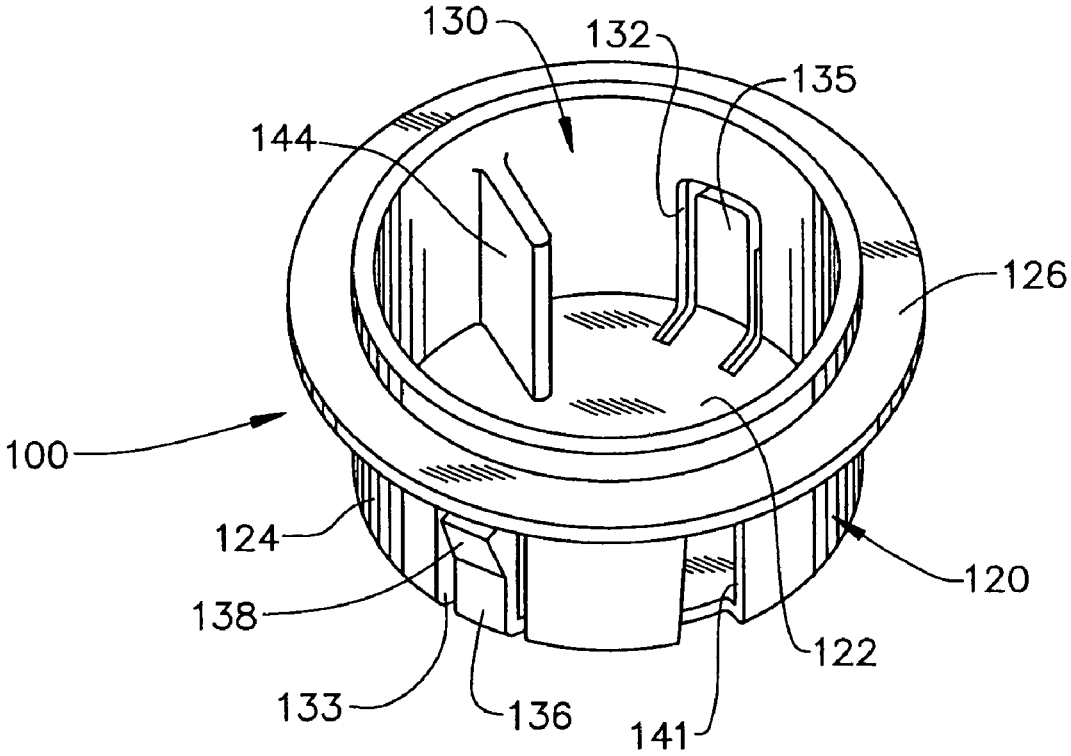
FIG. 3 is a perspective view of the coupler of FIG. 2.

As best shown in FIG. 3, coupler 100 includes a main body portion 120 having a bottom section 122 and a circumferential side section 124 that is provided with an upper, circular flange 126 which collectively define an interior portion 130. Interior portion 130 preferably includes first and second openings 132 and 133 having arranged therein corresponding first and second clip members 135 and 136, each having a respective tab member, one of which is indicated at 138. Preferably, clip members 135 and 136 are cantilevered from bottom section 122 with tab members 138 being spaced from flange 126.

With this construction, coupler 100 is mounted to bin 41 by first inserting main body portion 120 into opening 101. As main body portion 120 is inserted, clip members 135 and 136 and, more particularly, tab members 138 engage with side edge portions (not separately labeled) of opening 101, causing clip members 135 and 136 to deflect inward. Once coupler 100 is fully seated, clip members 135 and 136 deflect back outward, with clip members 135 and 136 trapping rear wall 61 between flange 126 and tab members 138, while still allowing coupler 100 to rotate in a manner that will be described more fully below. Main body portion 120 is also shown to include a third opening 141 which is positioned so as to receive second end portion 88 of auger 85, as well as a cog member 144 that projects outward from circumferential side section 124 towards a center of bottom section 122. As best shown in FIG. 2, second end portion 88 of auger 85 wraps around side section 124 before passing through opening 141.

Figure 4:
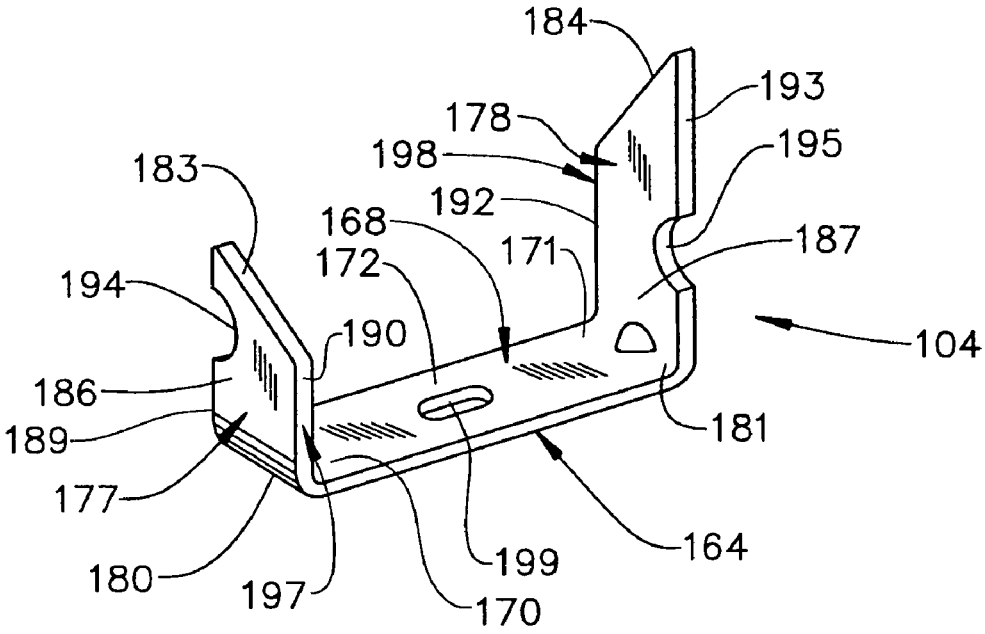
FIG. 4 is a perspective view of the drive member of FIG. 2.

Reference will now be made to FIG. 4 in describing drive member 104 constructed in accordance with the present invention. As shown, drive member 104 includes a main body section 164 having a base section 168 including a first end section 170 that extends to a second end section 171 through an intermediate section 172. In accordance with the invention, drive member 104 includes first and second arm members 177 and 178 that project substantially perpendicularly from corresponding ones of first and second end sections 170 and 171. Each arm member 177, 178 includes a corresponding first end portion 180, 181 that leads to a respective second end portion 183, 184 through a corresponding intermediate portions 186, 187. Intermediate portion 186 includes first and second opposing side edges 189 and 190 that extend from first end portion 180 to second end portion 183. In a similar manner, intermediate portion 187 includes first and second opposing side edges 192 and 193 that extend between first end portion 181 and second end portion 184.

In accordance with the most preferred form of the invention, each second end portion 183, 184 is chamfered or angled so as to more readily receive coupler 100. That is, the angling or chamfering of second end portions 183 and 184 ensures that coupler 100 readily receives drive member 104 when bin 41 is inserted into freezer compartment 12. In addition, first arm member 177 is shorter than second arm member 178. This arrangement ensures that, when inserting bin 41 into freezer compartment 12, second arm member 178 initially enters into coupler 100, with angled end portion 184 aiding in establishing a desired alignment. As bin 41 is seated, first arm member 177 enters coupler 100 to further ensure a positive connection between bin 41 and drive member 104.

In further accordance with the most preferred form of the invention, drive member 104 includes first and second arcuate notches 194 and 195 formed on opposing side edges, e.g., side edges 189 and 193, of corresponding ones of each intermediate portion 186, 187 of arm members 177 and 178. Arcuate notches 194 and 195 are sized to receive second end portion 88 of auger 85 as will be discussed more fully below. Positioned opposite arcuate notches 194 and 195, each arm member 177, 178 includes a drive flat 197 and 198 defined by second side edge 190 and first side edge 192 respectively. Finally, drive member 104 is shown to include an opening 199 provided in intermediate section 172 that is designed to receive shaft 107 in order to mount drive member 104 to motor 106 for co-rotation.

Having described the preferred constructions of bin 41, coupler 100 and drive member 104, reference will now be made to FIGS. 5-8 in describing a preferred method of operation of icemaker assembly 30. Initially, it should be noted that bin 41 is readily removable from freezer compartment 12 in order to enable a consumer to remove any ice cubes stored within storage section 69 in bulk. Once emptied, bin 41 is reinserted into freezer compartment 12 such that coupler 100 engages with drive member 104. As discussed above, the relative size of arm members 177 and 178 coupled with the chamfering of second end portions 183 and 184 ensures that coupler 100 readily receives drive member 104 so as to prevent any misalignment, thereby ensuring proper operation of auger 85. In any event, once back in position, drive member 104 can be rotated by motor 106 upon activation of a door dispenser (not shown). That is, a consumer wishing to retrieve ice from bin 41 without accessing freezer compartment 12 may employ a door mounted ice dispenser (not shown) of a type known in the art.

In accordance with the present invention, the dispenser allows a consumer to choose between crushed ice, causing motor 106 to rotate auger 85 in a counterclockwise direction, or cubed ice, resulting in a clockwise rotation of auger 85. As auger 85 actually transports the ice from bin 41 to lower outlet 75, it is important to ensure a positive connection between drive member 104 and coupler 100, as well as a positive connection to second end portion 88 of auger 85 particularly when dispensing crushed ice. That is, forces generated by crushing ice cubes could cause bin 41 to migrate forward and disengage from drive member 104.

Figure 5:
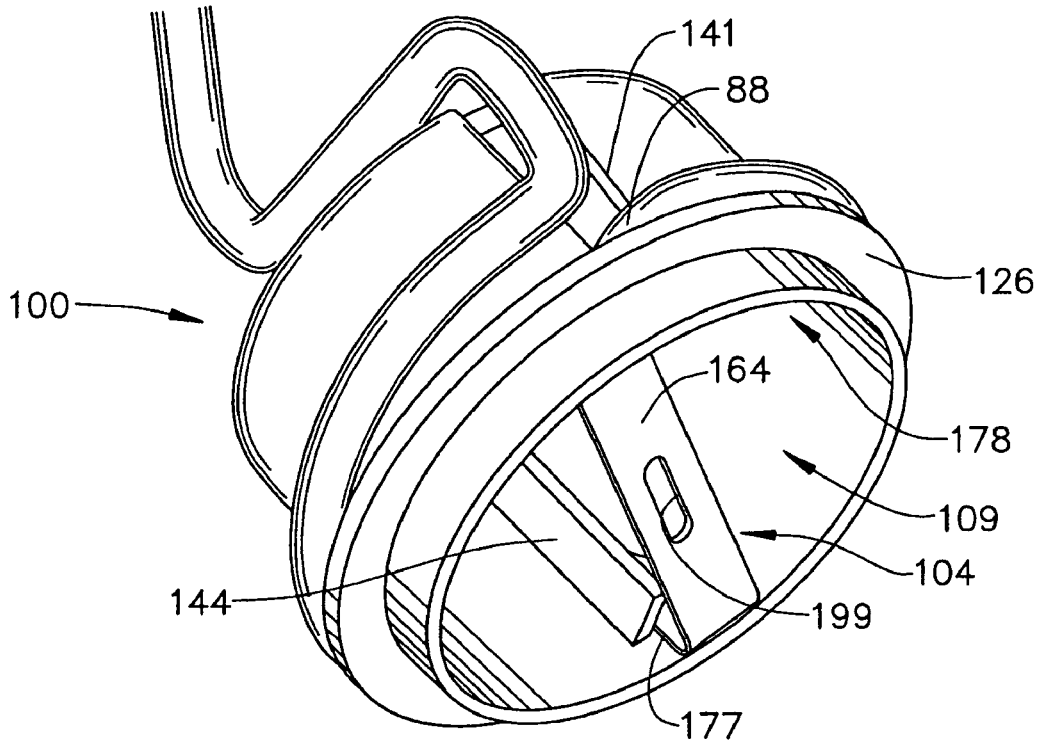
FIG. 5 is a perspective view of the another arm of the drive member engaging with the cog member in the coupler to rotate the auger in an ice cube dispensing operation.
Figure 6:
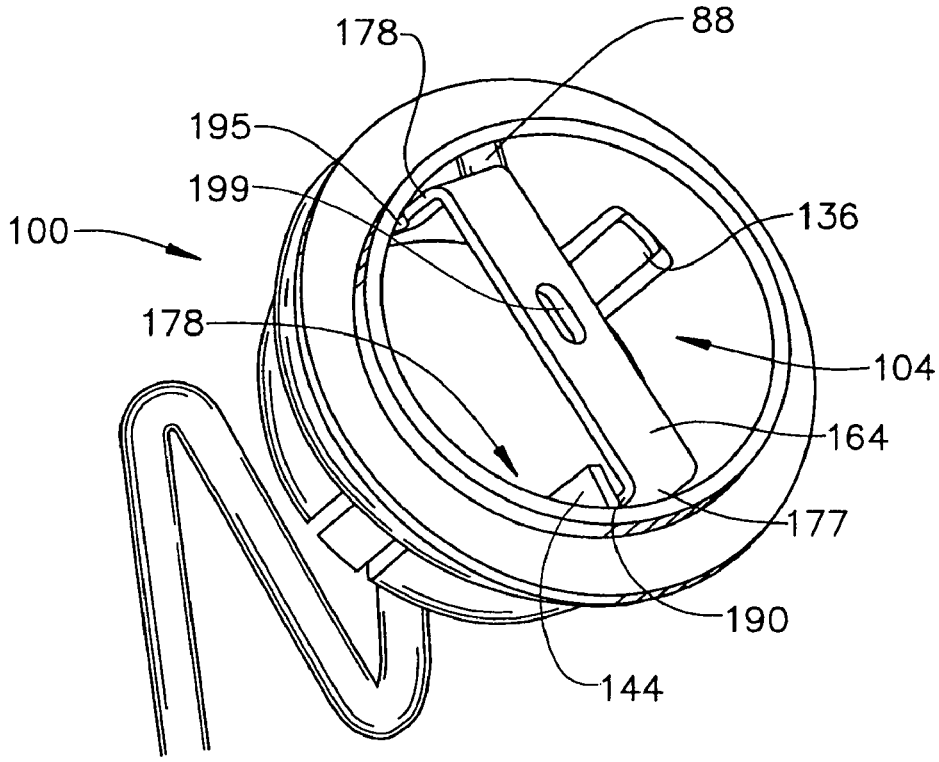
FIG. 6 is a perspective view of the arm of the drive member of FIG. 5 engaging with the auger.
Figure 7:
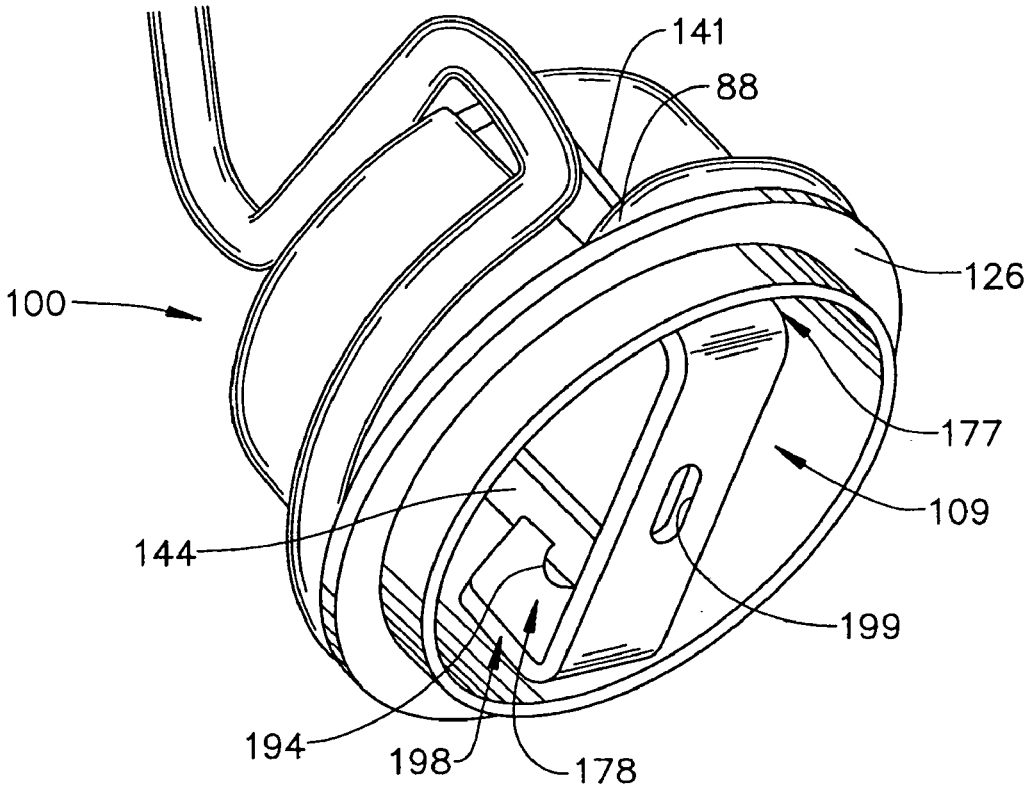
FIG. 7 is a perspective view of an arm of the drive member engaging with a cog member in the coupler to rotate the auger in a crushed ice dispensing operation.
Figure 8:
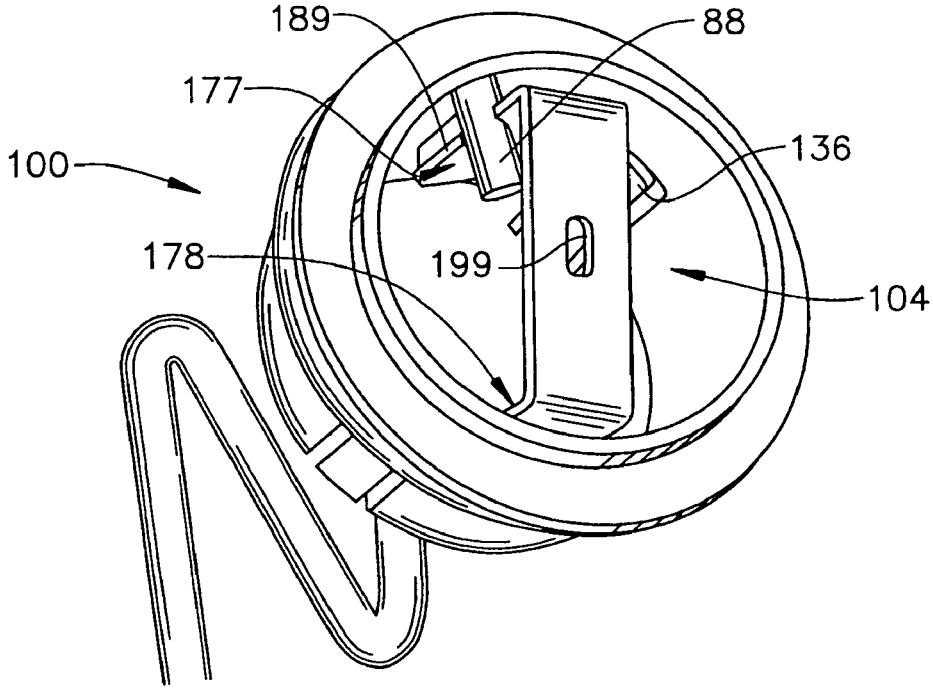
FIG. 8 is a perspective view of another arm of the drive member of FIG. 7 engaging with the auger through the coupler.

Accordingly, when rotated for an ice cube dispensing operation as shown in FIGS. 5 and 6, first arm member 177 of drive member 104 engages with cog member 144 to impart rotation to auger 85 while second arm member 178 engages with second end portion 88 of auger 85. More specifically, when operated to dispense ice cubes, second arm member 178 engages with second end portion 88 of auger 85 through drive flat 198 such as shown in FIG. 6. Conversely, during a crushed ice dispensing operation as shown in FIGS. 7 and 8, drive member 104 rotates in a counterclockwise direction, causing first arm member 177 to engage with and retain second end portion 88 of auger 85. More particularly, when rotated in the crushed ice dispensing operation, first arm member 177 engages with second end portion 88 of auger 85 at arcuate notch 194 to establish a direct, positive connection. At the same time, second arm member 178 engages with cog member 144.

At this point, it should be understood that a limited amount of play exists between coupler 100 and second end portion 88 to allow first and second arm members 177 and 178 to simultaneously contact both auger 85 and cog member 144 when rotating in each direction. In this manner, the present invention provides a solid interface for operating crusher/dispenser 79, particularly in a crushed ice dispensing mode. That is, with the forces generated when crushing ice, drive member 104 directly engages with and retains second end portion 88 of auger 85 to ensure proper operation and prevent ice bin 41 from migrating away from drive member 104.

Based on the above, it should be readily apparent that the present invention provides, in each of two difference drive configurations, a positive connection between a drive member and an auger of an ice bin, with the auger being further maintained in a positive drive condition during ice crushing operations. More specifically, the present invention provides for a drive member that is readily received by a coupler when an ice bin is inserted into a freezer compartment 12, yet ensures distinct positive connections to an ice auger in order to effectively enable an icemaker assembly to selectively operate to dispense cubed or crushed ice. Also, while described with first arm member 177 engaging with and retaining auger 85, second arm member 178 could also operate in this manner depending upon a particular orientation of drive member 104. Although described with reference to a preferred embodiment of the invention, it should be readily understood that various changes and/or modifications can be made to the invention without departing from the spirit thereof. For instance, while shown as a side-by-side style refrigerator, the invention is applicable as a factory installation or retrofit arrangement in various refrigerator models including top mount, bottom mount and French door-type refrigerators. In addition, although the auger is shown to be generally serpentine in shape, other shapes, including a helical arrangement, could be employed. In general, the invention is only intended to be limited by the scope of the following claims.

We claim:

1. A refrigerator comprising:

a cabinet defining at least a freezer compartment; and an icemaker assembly mounted in the freezer compartment, said icemaker assembly including:

a bin removably mounted in the freezer compartment, said bin including a bottom wall, as well as first and second pairs of opposing side walls, with one of the first pair of opposing side walls including an opening;

a coupler rotatably mounted in the opening of the bin, said coupler including a recessed interior portion having an aperture and a cog member;

an auger rotatably mounted in the bin, said auger including a first end portion extending through the aperture of the coupler leading to a second end portion; and a drive member extending within the freezer compartment and operatively connected to the coupler, said drive member including at least one arm member having first and second opposing side edges, said first and second opposing side edges being provided with an arcuate notch and a drive flat respectively, said drive member being driven in a first direction during an ice cube dispensing operation to cause a corresponding rotation of the auger and, in a second direction during a crushed ice dispensing operation to cause a corresponding rotation of the auger, said at least one arm member engaging the cog member through the drive flat to establish an indirect connection to the auger when being rotated in the first direction and, said at least one arm member engaging the first end portion of the auger with the first portion of the auger nesting within the arcuate notch to establish a direct and positive connection to the auger when being driven in the second direction.

2. The refrigerator according to claim 1, further comprising: a motor including a drive shaft mounted in the freezer compartment, said motor being adapted to drive the drive member during the ice cube dispensing operation and the crushed ice dispensing operation.

3. The refrigerator according to claim 2, wherein the drive member includes a main body section having first and second end sections joined through an intermediate section, said intermediate section including an opening adapted to receive the drive shaft of the motor.

4. The refrigerator according to claim 3, wherein the at least one arm member of the drive member includes a first end portion, a second end portion with said first and second opposing edges being provided on an intermediate portion extending between the first and second end portions, said first end portion extending, substantially perpendicularly outward from the first end section of the drive member and said second end portion of the first arm member being angled.

5. The refrigerator according to claim 3, wherein the at least one arm member includes a first arm member and a second arm member, said second arm member having a first end portion, a second end portion and an intermediate portion having first and second side edges provided with an arcuate notch and a drive flat respectively, said first end portion extending, substantially perpendicularly outward from the second end section of the drive member and said second end portion being angled.

6. The refrigerator according to claim 5, wherein when driven in the first direction, said second arm member engaging the first end portion of the auger through the drive flat and, when driven in the second direction, said second arm member engages with the cog member.

7. The refrigerator according to claim 1, wherein the coupler includes a main body portion having a bottom section and a circumferential side section that collectively define the recessed interior portion.

8. The refrigerator according to claim 7, wherein the aperture is formed in the circumferential side section.

9. The refrigerator according to claim 7, wherein the cog member extends from the bottom section and along the circumferential side section.

10. The refrigerator according to claim 9, wherein the cog member projects inwardly from the circumferential side section toward a central portion of the interior portion.

11. The refrigerator according to claim 7, wherein the coupler includes at least one clip member provided on the circumferential side section, said at least one clip member including a tab element that is adapted to engage with the bin to rotatably support the coupler.

12. The refrigerator according to claim 11, wherein the circumferential side wall includes an opening, said clip member projecting from the bottom section within the opening.

13. The refrigerator according to claim 1, wherein the bin includes an ice dispenser/crusher operatively coupled to the auger, said drive member rotating the auger, through the coupler, to operate the ice dispenser/crusher.

14. A method of operating an ice dispenser assembly of a refrigerator icemaker including a bin for storing ice cubes, an auger positioned in the bin for guiding the ice cubes towards a dispenser, a coupler rotatably mounted relative to the bin and connected to the auger, and a drive member including at least one arm member having first and second opposing side edges comprising:

operating the ice dispenser assembly for an ice cube dispensing operation by rotating the drive member in a first direction, wherein said drive member drives the auger through an interaction of the drive member and a cog member of the coupler; and operating the ice dispenser assembly in a crushed ice dispensing operation by rotating the drive member in a second direction, wherein said drive member drives the auger through a direct, positive engagement with an end portion of the auger which is nested in an arcuate notch formed in the drive member.

15. The method of claim 14 wherein, when rotating in the first direction, said drive member engages the auger through a drive flat provided on the at least one arm member.

16. The method of claim 15 wherein, when rotating in the second direction, said drive member engages the cog member through the at least one arm member.

* * * * *